US008784045B2

(12) United States Patent
Zoric et al.

(10) Patent No.: US 8,784,045 B2
(45) Date of Patent: Jul. 22, 2014

(54) SEAL ASSEMBLY

(75) Inventors: Tatjana Zoric, Derby (GB); James D. Godwin, Derby (GB)

(73) Assignee: Rolls-Royce PLC, London (GB)

( * ) Notice: Subject to any disclaimer, the term of this patent is extended or adjusted under 35 U.S.C. 154(b) by 188 days.

(21) Appl. No.: 13/177,370

(22) Filed: Jul. 6, 2011

(65) Prior Publication Data

US 2012/0032403 A1 Feb. 9, 2012

(30) Foreign Application Priority Data

Aug. 3, 2010 (GB) ..... 1013004.5

(51) Int. Cl.

*F01D 5/20* (2006.01)
*F01D 11/00* (2006.01)
*F01D 11/02* (2006.01)

(52) U.S. Cl.

CPC ..... *F01D 11/001* (2013.01); *F01D 11/02* (2013.01)
USPC ..... 415/173.5; 277/411; 277/412; 277/418; 277/419

(58) Field of Classification Search

USPC ..... 277/411, 412, 418, 419; 415/173.5
See application file for complete search history.

(56) References Cited

U.S. PATENT DOCUMENTS 2,123,818 A * 7/1938 Wegmann ..... 277/419
3,572,728 A 3/1971 Smuland
3,701,536 A * 10/1972 Matthews et al. ..... 277/415
3,897,169 A * 7/1975 Fowler ..... 415/173.6
3,940,153 A 2/1976 Stocker
4,513,975 A * 4/1985 Hauser et al. ..... 277/415
4,521,159 A * 6/1985 Pask ..... 416/174
4,715,213 A * 12/1987 McGreehan et al. ..... 73/40.7
5,029,876 A 7/1991 Orlando et al.
5,244,216 A * 9/1993 Rhode ..... 277/303
5,639,095 A * 6/1997 Rhode ..... 277/303
5,833,244 A * 11/1998 Salt et al. ..... 277/421
5,967,745 A 10/1999 Tomita et al.
5,984,630 A * 11/1999 Di Salle et al. ..... 415/174.5
6,164,655 A 12/2000 Bothien et al.
6,692,227 B2 2/2004 Tomita et al.
7,445,213 B1 * 11/2008 Pelfrey ..... 277/418

(Continued)

FOREIGN PATENT DOCUMENTS

DE 10 2007 004 743 A1 8/2008
EP 1 515 035 A2 3/2005

OTHER PUBLICATIONS

Feb. 21, 2014 Office Action issued in U.S. Appl. No. 13/177,245.

(Continued)

*Primary Examiner* — Kristina Fulton
*Assistant Examiner* — Eugene G Byrd
(74) *Attorney, Agent, or Firm* — Oliff PLC

(57) ABSTRACT

A seal assembly including first and second components; a seal arranged between the first and second components to seal a secondary flow region from a primary flow region; and a second recess portion provided on a surface of the second component between the seal and the primary flow region, the second recess portion further being arranged to receive a first portion of a flow from the secondary flow region and being configured to promote a second flow feature within the second recess portion, wherein the second recess portion is set back from the surface of the second component such that a second portion of the flow from the secondary flow region bypasses the second recess portion.

15 Claims, 5 Drawing Sheets

(56) References Cited

U.S. PATENT DOCUMENTS

| | | | | |
|---|---|---|---|---|
| 7,708,520 | B2 * | 5/2010 | Paolillo et al. | 415/174.5 |
| 8,002,286 | B1 * | 8/2011 | El-Aini et al. | 277/412 |
| 8,167,547 | B2 * | 5/2012 | Wu et al. | 415/173.5 |
| 8,333,557 | B2 * | 12/2012 | John et al. | 415/173.1 |
| 2008/0124215 | A1 | 5/2008 | Paolillo et al. | |
| 2009/0067997 | A1 | 3/2009 | Wu et al. | |
| 2009/0317232 | A1 | 12/2009 | Guemmer | |
| 2010/0008760 | A1 | 1/2010 | Morris et al. | |
| 2010/0074733 | A1 | 3/2010 | Little | |
| 2011/0156359 | A1 * | 6/2011 | Zheng et al. | 277/418 |

OTHER PUBLICATIONS

Nov. 12, 2013 European Search issued in European Application No. 11 17 2841.

U.S. Appl. No. 13/177,245 in name of Bagnall filed on Jul. 6, 2011.

* cited by examiner

SEAL ASSEMBLY

This invention relates to a seal assembly and particularly but not exclusively relates to a seal assembly for a gas turbine engine.

BACKGROUND

FIG. 1*a* shows a section of an Intermediate Pressure (IP) compressor 10 from a three-shaft gas turbine. As shown, air may be bled from a mid stage of the IP compressor via a duct 12 to pressurise the fan disk and/or front 14 of the IP compressor 10, e.g. for sealing purposes. However, the high-pressure bleed air may leak into the mainstream 15 through a front seal 16, which is marked with a circle in FIG. 1*a* and shown in greater detail in FIG. 1*b*.

It is known to provide seals between moving and stationary components, e.g. a rotor disk 22 and seal carrier 23, and typically such seals comprise labyrinth seals. The front seal 16 shown in FIGS. 1*a* and 1*b* may comprise such a labyrinth seal. Generally, there are two types of labyrinth seal, the first being a "straight through" type with a succession of upstanding edged fins extending across the leakage gap. The second type of labyrinth seal, as shown in FIG. 1*b*, may comprise a "stepped" labyrinth seal in which there are again a succession of upstanding edged fins 18, but the opposed surface 20 is stepped to convolute the flow path. A leakage through the gaps between the upstanding edged fins and the opposed surfaces may therefore be further constricted. Examples of labyrinth seal are disclosed in the following documents: US2008124215, US2009067997, U.S. Pat. Nos. 5,029,876, 3,572,728, 3,940,153 and 7,445,213.

Typically, the edged fins of a labyrinth seal are formed from solid metal with sharp machined edges to maximise the constriction of flow through the leakage gap. It will be understood that this leakage is due to a pressure differential across a rotary component, which may be a stage of a compressor or turbine in an engine. This pressure differential drives the blades or vanes of the turbine (or vice versa in the case of a compressor). Therefore any leakage about the edges of these blades or vanes through the leakage gaps reduces the efficiency as this pressurised working fluid provides no work (or in the case of a compressor requires further work) and may present detrimental mixing losses.

The effectiveness of a labyrinth seal is subject to a number of factors. These factors include manufacturing constraints, in service conditions and geometrical limitations. Typically, the clearance between the upstanding fin and its opposed surface is a significant factor with regard to the specification of an appropriate seal. This clearance dimension should be as small as possible within the housing but without rotating part clashes or touching during normal operation.

Multiple constrictions in series may reduce the leakage mass flow by reducing the pressure drop across each constriction, hence reducing the leakage velocity through the clearance. The leakage flow is typically choked at the last fin. In previously-proposed front seal designs, as shown in FIG. 1*b* (and FIG. 3*a*), a high-speed jet 21 at the exit of the last fin hits the rotor blade disk 22, and stays attached to the disk, thereby increasing windage losses. In addition, the leakage enters the mainstream flow 15 as a cross-flow with a high radial velocity and radial angle. This increases mixing losses and aerodynamic spoiling at the IP compressor inlet. Furthermore, the leakage air is at a higher temperature than the mainstream, and thus has detrimental effect on the efficiency.

The present disclosure therefore seeks to address these issues.

STATEMENTS OF INVENTION

According to a first aspect of the present disclosure there is provided a seal assembly comprising: first and second components; a seal arranged between the first and second components to seal a secondary flow region from a primary flow region; and a second recess portion provided on a surface of the second component adjacent to the seal, the second recess portion further being arranged to receive a first portion of a flow from the secondary flow region and being configured to promote a second flow feature within the second recess portion, wherein the second recess portion is set back from the surface of the second component such that a second portion of the flow from the secondary flow region bypasses the second recess portion.

The seal assembly may further comprise a first recess portion provided on the surface of one of the first and second components and arranged between the seal and the primary flow region. The first recess portion may be arranged to receive flow from the secondary flow region and shed flow to the primary flow region. The first recess portion may be configured to promote a first flow feature. The first flow feature may flow with a portion of the first flow feature adjacent to the primary flow region. The portion of the first flow feature may be shed to the primary flow region in substantially the same direction as the flow in the primary flow region. The first recess portion may be arranged between the second recess portion and the primary flow region.

According to a second aspect of the present disclosure there is provided a seal assembly comprising: first and second components; a seal arranged between the first and second components to seal a secondary flow region from a primary flow region; and a first recess portion provided on the surface of one of the first and second components and arranged between the seal and the primary flow region, the first recess portion further being arranged to receive flow from the secondary flow region and shed flow to the primary flow region, wherein the first recess portion is configured to promote a first flow feature, the first flow feature flowing with at least a portion of the first flow feature adjacent to the primary flow region and the portion of the first flow feature being shed to the primary flow region in substantially the same direction as the flow in the primary flow region.

The first and/or second recess portions may be arranged in a cavity between the seal and the primary flow region. The cavity may be defined by surfaces of the first and second components.

The second recess portion may be upstream or downstream of the seal. The second recess portion may be between the seal and the primary flow region. The second recess portion may be configured such that the second flow feature disturbs the flow from the secondary flow region. A third flow feature may be formed downstream of the second flow feature. The third flow feature may deflect flow away from a surface of the first component. The third flow feature may shed flow into the first flow feature.

The seal may be arranged such that it is the last seal in a plurality of labyrinth seals. The seal may comprise a knife edge seal. Knife edge portions of the knife edge seal may be provided on the first component.

The third flow feature may comprise a vortex. The second flow feature may comprise a vortex. The first flow feature may comprise a vortex.

The second component may be a static component. The first component may be a movable component, e.g. movable with respect to the static component (or vice versa).

A turbomachine, e.g. compressor or turbine, or a gas turbine may comprise the above-described seal assembly.

BRIEF DESCRIPTION OF THE DRAWINGS

For a better understanding of the present invention, and to show more clearly how it may be carried into effect, reference will now be made, by way of example, to the accompanying drawings, in which:—

DETAILED DESCRIPTION

Figure 2:
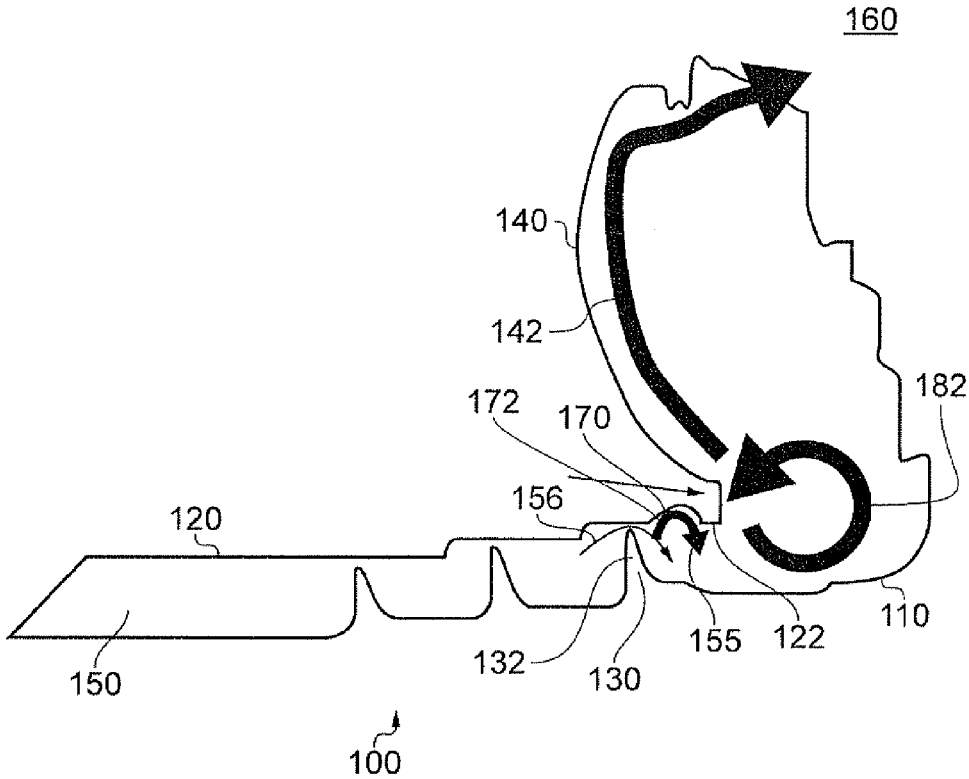
FIG. 2 shows a seal assembly according to an example of the present disclosure.

With reference to FIG. 2, a seal assembly 100 according to an example of the present disclosure may comprise a seal 130 arranged between first and second components 110, 120. The second component 120 may be a static component and the first component 110 may be a movable component movable with respect to the static component (or vice versa). The first component 110 may rotate with respect to the second component 120. The seal 130 may comprise one or more knife edge or labyrinth seals. Knife edge portions or fins 132 of the seal may be provided on the first component 110. The seal 130 may seal a secondary flow region 150, e.g. a non-mainstream flow, from a primary flow region 160, e.g. a mainstream flow.

A flow passage 155 from the secondary flow region 150 to the primary flow region 160 may be defined by surfaces of the first and second components 110, 120. The primary flow region 160 may comprise a fluid, e.g. air, which flows over surfaces of the first and second components 110, 120 (not shown). A leakage flow 156 may flow from the secondary flow region 150 through a gap in the seal 130 and flow passage 155 to the primary flow region 160. The leakage flow 156 may join the fluid flow in the primary region 160.

The seal assembly 100 may further comprise a second recess portion 170, which may be provided in a surface of the second component 120 and in the passage 155. The second recess portion 170 may be arranged to receive a first portion of the leakage flow 156 from the secondary flow region 150. The second recess portion 170 may be set back from the surface of the second component 120 such that a second portion of the flow from the secondary flow region may bypass the second recess portion. The second recess portion 170 may be configured to promote a second flow feature 172, e.g. a vortex, within the second recess portion.

The seal assembly 100 may further comprise a first recess portion 140, which may be provided in a surface of the second component 120 and in the passage 155. The first recess portion 140 may be arranged between the seal 130 and the primary flow region 160. The second recess portion 170 may be arranged between the first recess portion 140 and the seal 130. The first recess portion 140 may further be arranged to receive a flow from the secondary flow region 150, e.g. leakage flow 156 through the seal 130, and deliver flow to the primary flow region 160. The first recess portion 140 may be configured to promote a first flow feature 142, e.g. a vortex or a flow turning through an angle, within the first recess portion. The first flow feature 142 may flow with a portion of the first flow feature adjacent to the primary flow region 160. The portion of the first flow feature 142 may be shed to the primary flow region 160 in substantially the same direction as the flow in the primary flow region at the interface between the first and second components 110, 120 adjacent to the mainstream. The second flow feature 172 may shed flow to the first flow feature 142.

The first and/or second recess portions 140, 170 may be curved. The first and/or second recess portions 140,170 may be concave. The first and second recess portions may be arranged either side of an apex or corner 122 in the surface of the second component 120. The labyrinth seal itself may remain unchanged from previously-proposed arrangements. The radius of the second recess portion 170, e.g. a shaped cut-out, may be greater than that of the seal fins 132 to enable assembly and avoid a clash in the event of relative axial movement between the seal carrier and drum, e.g. first and second components, during running. In other words the shaped cut-out, including its edges, may be formed beyond a radius from the axis of rotation of the first component 110, which is greater than the radius of the tip of the seal fin 132.

The second recess portion 170 may be configured such that the second flow feature 172 may disturb the leakage flow 156. A third flow feature 182, e.g. a vortex, may be formed downstream of the second flow feature 172. The third flow feature 182 may deflect flow away from a surface of the first component 110. The third flow feature 182 may shed flow into the first flow feature 142.

The seal assembly of the present disclosure may give an improvement in rotor efficiency of up to 0.2% or more relative to previously-proposed designs. This improvement may be achieved through a combination of the following factors. A shaped cut-out feature, e.g. the second recess portion 170, may be incorporated into the rear section of the seal carrier, e.g. second component 120. The cut-out feature may deflect a leakage flow 156 in a radially inward direction and thereby create flow spoiling and/or counter-rotating vortices 172, 182. The second cut-out feature may direct the leakage flow after the last fin 132 of a labyrinth seal, so that the first of the two counter-rotating vortices forms. As a result, there may be a decrease in the leakage mass flow. Furthermore, the vortex arrangement, e.g. third flow feature 182, may direct the leakage flow 156 away from the rotating first component 110 and onto the static second component 120, thereby reduce a windage loss. The static seal carrier wall, i.e. second component 120, may be curved, e.g. first recess portion 140, in order to reduce the radial velocity and angle of the leakage flow 156 as it enters the primary flow region, e.g. mainstream flow. In other words a more axial entry velocity of the leakage into the mainstream flow may be achieved. The leakage flow may therefore cause a lower aerodynamic loss at re-ingestion. Either or both of the first and second recess portions 140, 170 may be included to obtain an improvement in the efficiency, although the combined benefit may be greater than the sum of the individual benefits.

Figure 1A:
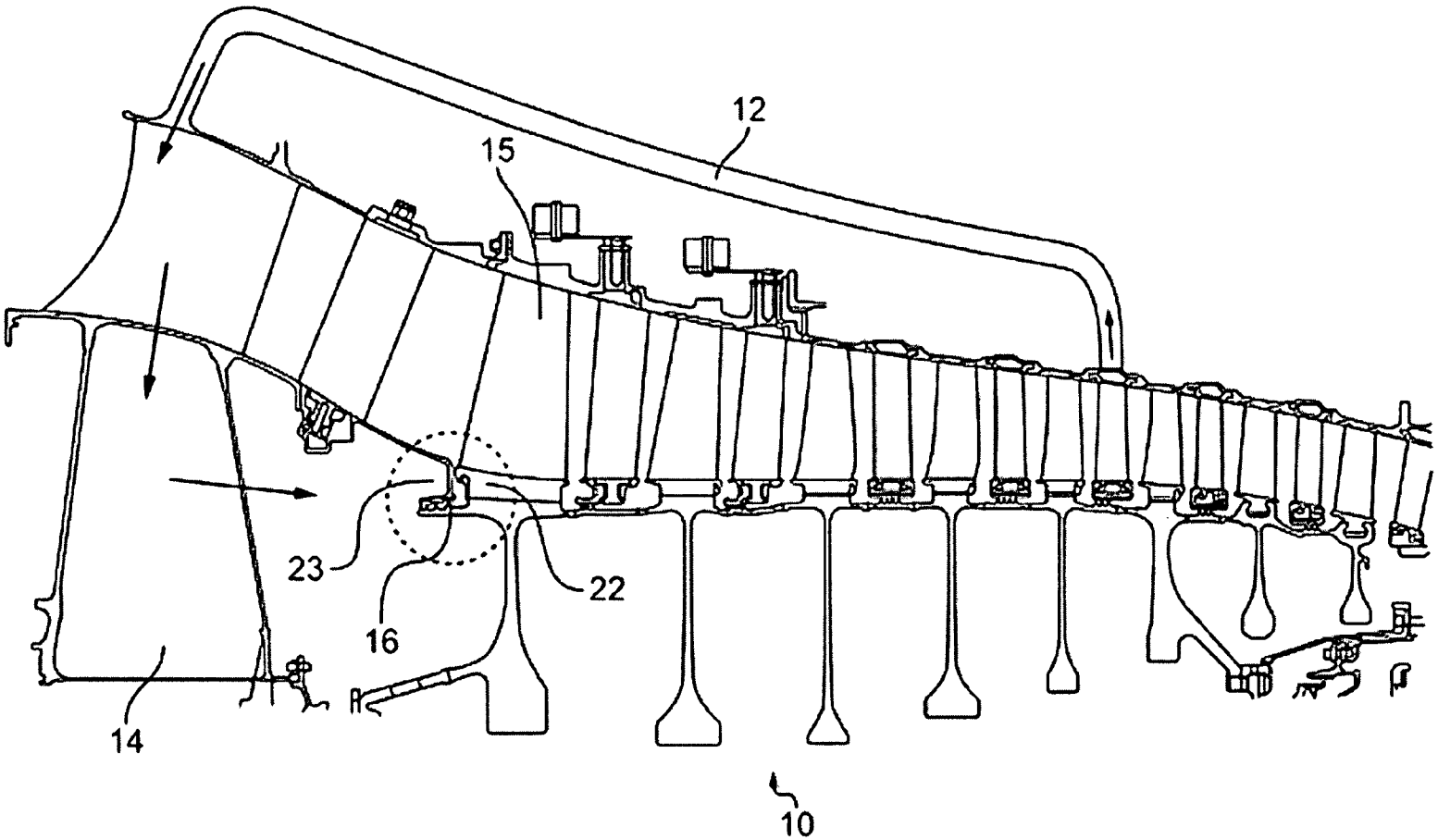
Prior Art FIG. 1A
FIG. 1*a* shows a section of an Intermediate Pressure (IP) compressor for a three-spool gas turbine and FIG. 1*b* shows an example of a seal in such a compressor.
Figure 1B:
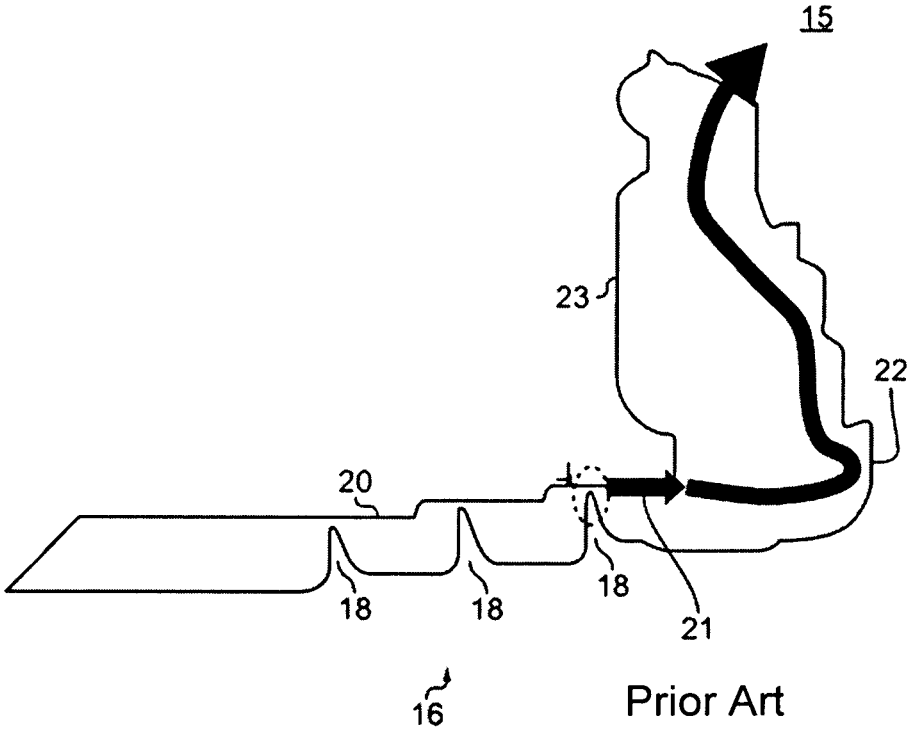

In the case of the seal assembly of the present disclosure being applied to the IP compressor shown in FIG. 1*a* (or any other compressor), the efficiency of the front row of the IP compressor and consequently the overall compressor efficiency may be improved.

Figure 3A:
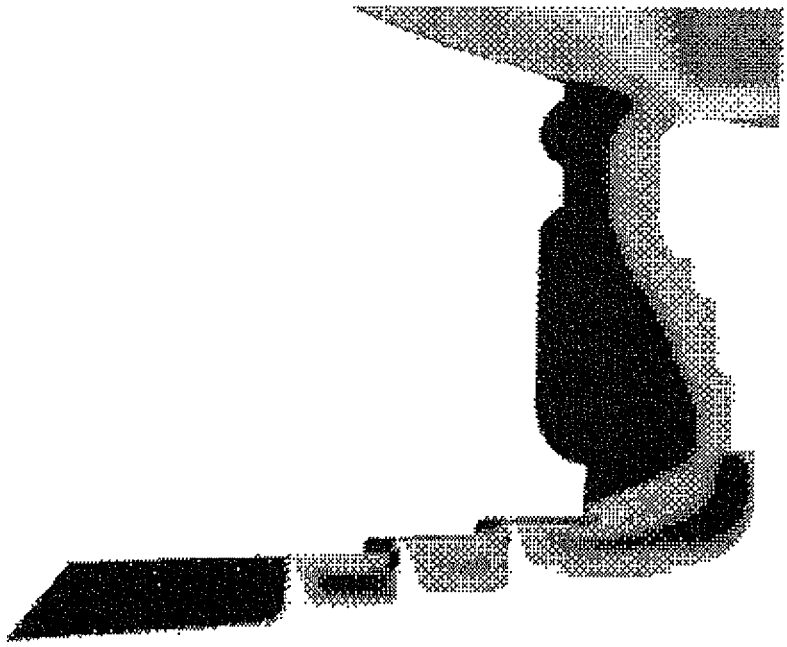
FIG. 3 shows Mach number contours for, a previously-proposed seal assembly (FIG. 3*a*) and an example of a seal assembly according to the present disclosure (FIG. 3*b*)
Figure 3B:
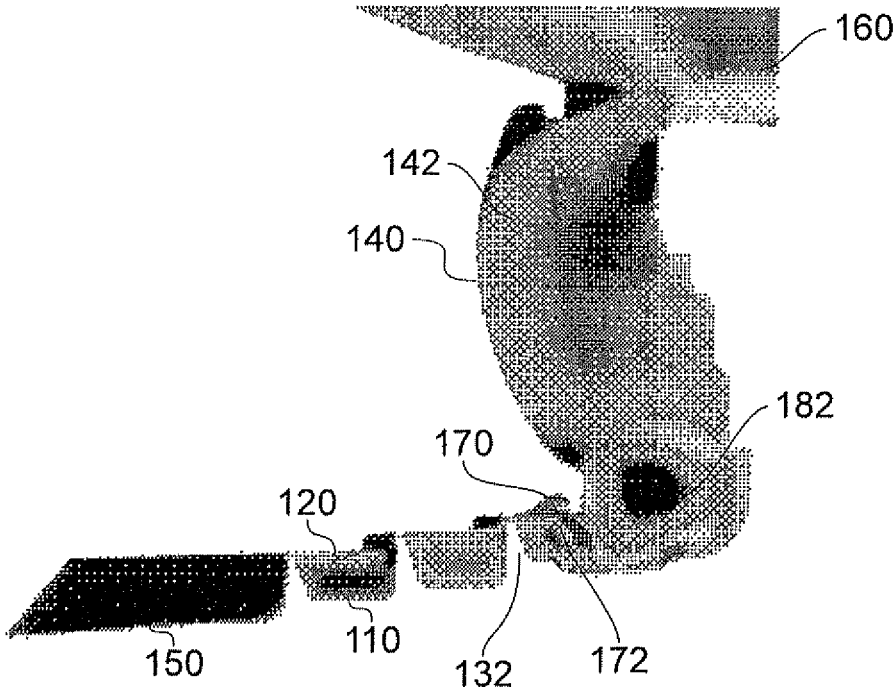

With reference to FIGS. 3*a* and 3*b* a comparison of the Mach number contours for a previously-proposed seal assembly (FIG. 3*a*) and a seal assembly of the present disclosure (FIG. 3*b*) is shown. FIG. 3*b* shows that a greater proportion of the high velocity flow is adjacent to the second non-rotating component 120, thereby reducing windage losses against the first rotating component 110. Furthermore, FIG. 3*b* shows the flow entering the mainstream 160 with a smaller radial velocity component and in a more axial direction, thereby reducing losses on re-ingestion into the mainstream.

Figure 4:
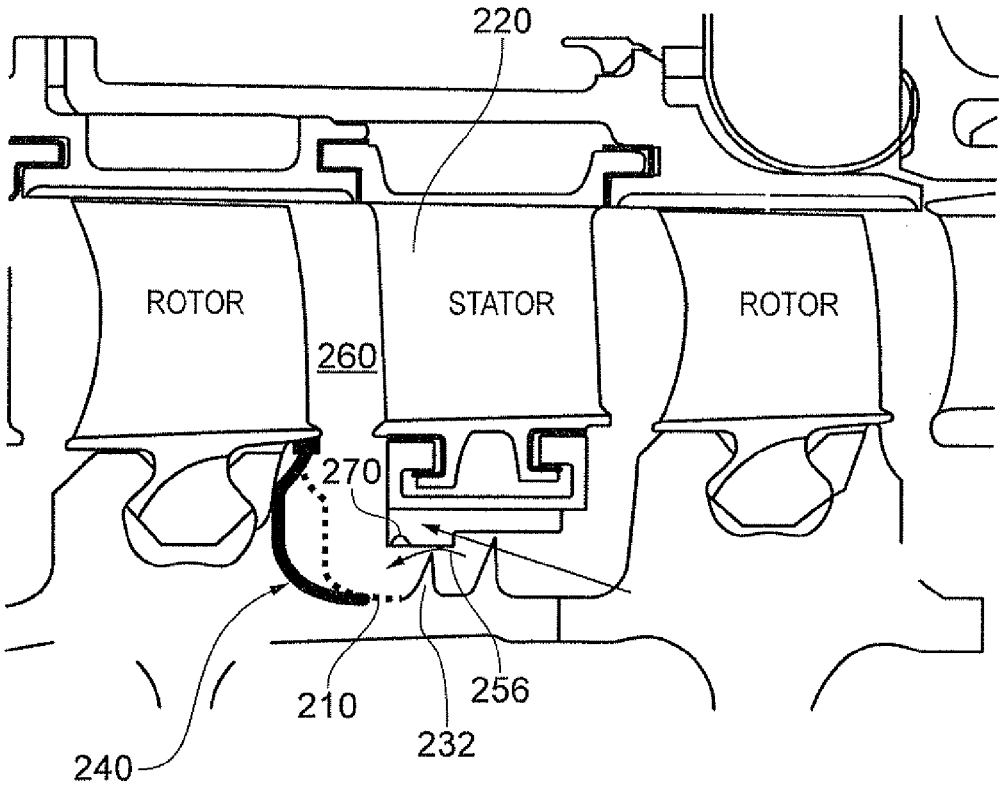
FIG. 4 shows a seal assembly according to a further example of the present disclosure applied to a stator shroud well.

The first and/or second recess portions may be included in any seal fin arrangement. For example, with reference to FIG. 4, aspects of the above-described sealing assembly may be used in a stator shroud well of a turbomachine, e.g. in a compressor or a turbine. As shown in FIG. 4, the static pressure may rise over compressor stator vanes 220 (or fall in the case of a turbine stator). As a result, a leakage flow 256 may travel under the stator 220 through a shroud well which is sealed. The first and/or second recess portions 240, 270 of the present disclosure may be applied to stator shroud well design as illustrated. However, in contrast to the earlier example, the first recess portion 240 may be provided on a surface of the first component 210. The first recess portion 240 may be downstream of the second recess portion 270. Furthermore, in an alternative arrangement (not shown) the second recess portion 270 may be located upstream of the final seal fin 232 to spoil the over-tip jet.

As before, the first and/or second recesses 240, 270 may help to ensure that the leakage flow 256 re-enters the main gas-path 260 in a favourable direction and/or reduce windage losses by the leakage flow impinging on the rotor disk 210. In the configuration shown in FIG. 4, the leakage flow 256 may remain attached to the rotating wall of the first component 210, and the curved profile of the first recess portion 240 may direct the re-injected flow into the mainstream 260 in a more favourable manner. The shaped cut-out, e.g. second recess portion, on the a wall of the stationary second component may spoil the leakage flow 256 and may reduce the flow rate and/or prevent the flow from bouncing off the rotating wall of the first component 210. The second recess portion may be referred to as the entry recess portion the first recess portion may be referred to as the exit recess portion, the second flow feature may be referred to as the entry flow feature, the first flow feature may be referred to as the exit flow feature, and the third flow feature may be referred to as the middle flow feature.

The invention claimed is:

1. A seal assembly comprising:

first and second components;

a seal arranged between the first and second components to seal a secondary flow region from a primary flow region; and an entry recess portion provided on a surface of the second component adjacent to the seal such that the entry recess portion is transverse to a direction of a flow, the entry recess portion further being arranged to receive a first portion of the flow from the secondary flow region and being configured to promote an entry flow feature within the entry recess portion, wherein the entry recess portion is set back from the surface of the second component such that a second portion of the flow from the secondary flow region bypasses the entry recess portion.

2. The seal assembly of claim 1, wherein the seal assembly further comprises:

an exit recess portion provided on the surface of one of the first and second components and arranged between the seal and the primary flow region, the exit recess portion further being arranged to receive flow from the secondary flow region and shed flow to the primary flow region, wherein the exit recess portion is configured to promote an exit flow feature, the exit flow feature flowing with a portion of the exit flow feature adjacent to the primary flow region and the portion of the exit flow feature being shed to the primary flow region in substantially the same direction as the flow in the primary flow region.

3. The seal assembly of claim 2, wherein the exit recess portion is arranged between the entry recess portion and the primary flow region.

4. The seal assembly of claim 1, wherein the entry recess portion is further configured such that the entry flow feature disturbs the flow from the secondary flow region to cause a middle flow feature to be formed downstream of the entry flow feature, the middle flow feature deflecting flow away from a surface of the first component.

5. The seal assembly of claim 4, wherein the middle flow feature sheds flow into the first flow feature.

6. The seal assembly as claimed in claim 4, wherein the middle flow feature comprises a vortex.

7. The seal assembly of claim 1, wherein the seal is arranged such that it is the last seal in a plurality of labyrinth seals.

8. The seal assembly of claim 1, wherein the seal comprises a knife edge seal.

9. The seal assembly of claim 8, wherein knife edge portions of the knife edge seal are provided on the first component.

10. The seal assembly as claimed in claim 1, wherein the entry flow feature comprises a vortex.

11. A seal assembly comprising:

first and second components;

a seal arranged between the first and second components to seal a secondary flow region from a primary flow region; and an exit recess portion provided on a surface of the one of the first and second components and arranged between the seal and the primary flow region, the exit recess portion further being arranged to receive flow from the secondary flow region and shed flow to the primary flow region, wherein the exit recess portion is a continuous curve extending transverse to the secondary flow region and configured to promote an exit flow feature within the exit recess portion, the exit flow feature flowing with a portion of the exit flow feature adjacent to the primary flow region and the portion of the exit flow feature being shed to the primary flow region in substantially the same direction as the flow in the primary flow region.

12. The seal assembly as claimed in claim 1, wherein the second component is a static component.

13. The seal assembly as claimed in claim 1, wherein the first component is a movable component.

14. A turbomachine comprising a seal assembly as claimed in claim 1.

15. A gas turbine comprising a seal assembly as claimed in claim 13.

* * * * *